US006387065B1

(12) United States Patent
Tumey

(10) Patent No.: US 6,387,065 B1
(45) Date of Patent: May 14, 2002

(54) REMOTE CONTROLLABLE MEDICAL PUMPING APPARATUS

(75) Inventor: David M. Tumey, San Antonio, TX (US)

(73) Assignee: Kinetic Concepts, Inc., San Antonio, TX (US)

( * ) Notice: Subject to any disclaimer, the term of this patent is extended or adjusted under 35 U.S.C. 154(b) by 0 days.

(21) Appl. No.: 08/722,296

(22) Filed: Sep. 30, 1996

(51) Int. Cl.[7] ..... A63B 21/00

(52) U.S. Cl. ..... 601/152; 601/152; 601/24; 601/35

(58) Field of Search ..... 601/149–159, 601/11, 24, 35

(56) References Cited

U.S. PATENT DOCUMENTS

| | | | | |
|---|---|---|---|---|
| 2,880,721 A | | 4/1959 | Corcoran et al. | |
| 3,824,992 A | | 7/1974 | Nicholson et al. | |
| 3,859,989 A | | 1/1975 | Spielberg | |
| 3,888,242 A | | 6/1975 | Harris et al. | |
| 3,908,642 A | | 9/1975 | Vinmont | |
| 3,993,053 A | | 11/1976 | Grossman | |
| 4,077,402 A | | 3/1978 | Benjamin, Jr. et al. | |
| 4,091,804 A | | 5/1978 | Hasty | |
| 4,202,325 A | | 5/1980 | Villari et al. | |
| 4,206,751 A | | 6/1980 | Schneider | |
| 4,235,437 A | * | 11/1980 | Ruis et al. | 482/902 |
| 4,402,312 A | | 9/1983 | Villari et al. | |
| 4,502,470 A | | 3/1985 | Kiser et al. | |
| 4,702,232 A | | 10/1987 | Gardner et al. | |
| 4,753,226 A | | 6/1988 | Zheng et al. | |
| 4,809,684 A | | 3/1989 | Gardner et al. | |
| 4,841,956 A | | 6/1989 | Gardner et al. | |
| 4,846,160 A | | 7/1989 | Gardner et al. | |
| 4,858,147 A | | 8/1989 | Conwell | |
| 4,993,420 A | | 2/1991 | Welkowitz et al. | |
| 5,014,714 A | | 5/1991 | Millay et al. | |
| 5,052,375 A | * | 10/1991 | Stark et al. | 482/902 |
| 5,060,279 A | | 10/1991 | Crawford et al. | |
| 5,090,417 A | | 2/1992 | Mollan et al. | |
| 5,099,851 A | | 3/1992 | Hata et al. | |
| 5,396,896 A | | 3/1995 | Tumey et al. | |
| 5,443,440 A | | 8/1995 | Tumey et al. | |
| 5,490,820 A | * | 2/1996 | Schock et al. | 601/151 |
| 5,575,762 A | * | 11/1996 | Peeler et al. | 601/152 |
| 5,584,798 A | * | 12/1996 | Foy | 601/150 |

* cited by examiner

*Primary Examiner*—Jerome W. Donnelly
(74) *Attorney, Agent, or Firm*—R. William Graham

(57) ABSTRACT

A remote controllable medical pumping apparatus for controlling from a local site the application of compressive pressures to a part of the human body located at a remote site includes means disposed at the remote site for applying compressive pressure about the body part in accordance with a predetermined pressure, means disposed at the remote site for sensing the predetermined pressure of the compressive pressure means and transmitting a signal in response thereto, means disposed at the local site for receiving and manipulating the transmitted signal to either select or generate a pressure signal and cycle signal, and means disposed at the local site for transmitting the selected or generated pressure signal and cycle signal, means at the remote site for receiving and manipulating the pressure signal and cycle and actuating the pressure means to cause application of pressure to the body part in accordance with the generated pressure signal and cycle signal.

22 Claims, 3 Drawing Sheets

REMOTE CONTROLLABLE MEDICAL PUMPING APPARATUS

BACKGROUND OF THE INVENTION

1. Field of the Invention

This invention relates to a remote controllable medical pumping apparatus and more particularly, but not by way of limitation, to a medical apparatus that is capable of controlling from a local site application of compressive pressures to a part of the human body at a remote site.

2. Related Art

Applying pressure to a part of the human body for the purpose of eliciting rapid blood transfer therefrom and subsequently producing Endothelial Derived Relaxing Factor (EDRF) is believed to have therapeutic effects. EDRF (Nitric Oxide) is understood to be a naturally occurring vasodilator which is produced by yield shear stress on the endothelial lining of veins. These shear stresses are readily produced by increasing peak blood flow velocities through a cross section of the vessels. EDRF helps produce hyperaemia by dilating vessels and opening capillaries which also assists in inhibiting the formation of thrombosis.

It is well known that thromboembolism and pulmonary emboli can result from trauma (such as produced by certain surgeries) or from prolonged venous stasis. These and other factors are known to contribute to the formation of Deep Vein Thrombosis (DVT) in the deep proximal veins of a patient undergoing hip/knee replacement and/or other orthopedic surgery.

Accordingly, pneumatic compression devices have been utilized on a part of the human body for the purpose of increasing and/or stimulating blood flow in an attempt to help prevent this DVT formation. Such devices have been made to adapt to an arm, hand, foot, calf and thigh and typically include an inflatable bladder or bladders connected to a pneumatic pump capable of delivering pressure within the bladder(s) to cause stimulation. Some devices inflate and deflate in a cyclical fashion, while others utilize a number of bladders which are inflated in a sequential fashion.

Such devices include an on-site integrally associated control panel interface for the setting, adjustment and programming of the preferred pressure levels and preferred cycle times for the application of pressure to the patient. Such devices required on-site knowledge and skill in order to successfully set, adjust or program its operating parameters in accordance with the on-site monitored patient data. Not infrequently, the patient, attendant or other third party inadvertently misadjusts the devices operating parameters. Thus, continuous on-site supervision and monitoring of the operating conditions are commonly required.

SUMMARY OF THE INVENTION

It is an object to improve medical pumping apparatus.

It is another object to ease the use of medical pumping apparatus.

It is an object of the present invention to provide a medical pumping apparatus which has a communications data link and remote controllability for the setting, adjusting and programming of a cycle interval and pressure for the apparatus.

It is an object of the present invention to provide a medical pumping apparatus which can accumulate data such as patient usage compliance, diagnostic and other specific patient information and then transmit said information over its communications data link.

It is still another object of the present invention to provide the medical pumping apparatus of the type described as part of a hospital bed.

Accordingly, the present invention is directed to a remote controllable medical pumping apparatus for controlling from a local site application of compressive pressures to a part of the human body at a remote site. The apparatus includes means disposed at the remote site for applying compressive pressure about the body part in accordance with a predetermined pressure, means disposed at the remote site and operatively associated with the pressure means for sensing at least one of pressure and cycle interval, first transmitting means disposed at the remote site and operatively associated with the sensing means for transmitting a signal in response to the sensed pressure and/or cycle interval, first receiving means disposed at the local site for receiving the transmitted signal, first manipulating means disposed at the local site operably associated with the first receiving means for manipulating the transmitted signal to select or generate a pressure signal and/or a cycle interval signal, second transmitting means disposed at the local site and operatively associated with the first manipulating means for transmitting the selected or generated pressure signal and/or cycle interval signal, second receiving means disposed at the remote site for receiving the selected or generated pressure signal, and second manipulating means disposed at the remote site and operatively associated with the second receiving means for manipulating the selected or generated pressure signal and/or cycle interval signal and actuating the pressure means to cause application of pressure to the body part in accordance with the selected or generated pressure signal and/or cycle interval signal.

Additionally the apparatus includes means disposed at the remote site for sensing patient compliance and wherein the first transmitting means further transmits a signal in response thereto and wherein the first receiving means further receives the patient compliance signal and wherein the first manipulating means further manipulates the transmitted patient compliance signal to either select or generate the pressure signal and/or cycle interval signal. Also, provided are means disposed at the remote site for sensing physiological data and wherein the first transmitting means further transmits a signal in response thereto and wherein the first receiving means further receives the physiological signal and wherein the first manipulating means further manipulates the transmitted physiological signal to either select or generate the pressure signal and/or cycle interval signal.

DETAILED DESCRIPTION OF THE PREFERRED EMBODIMENT

Figure 1:
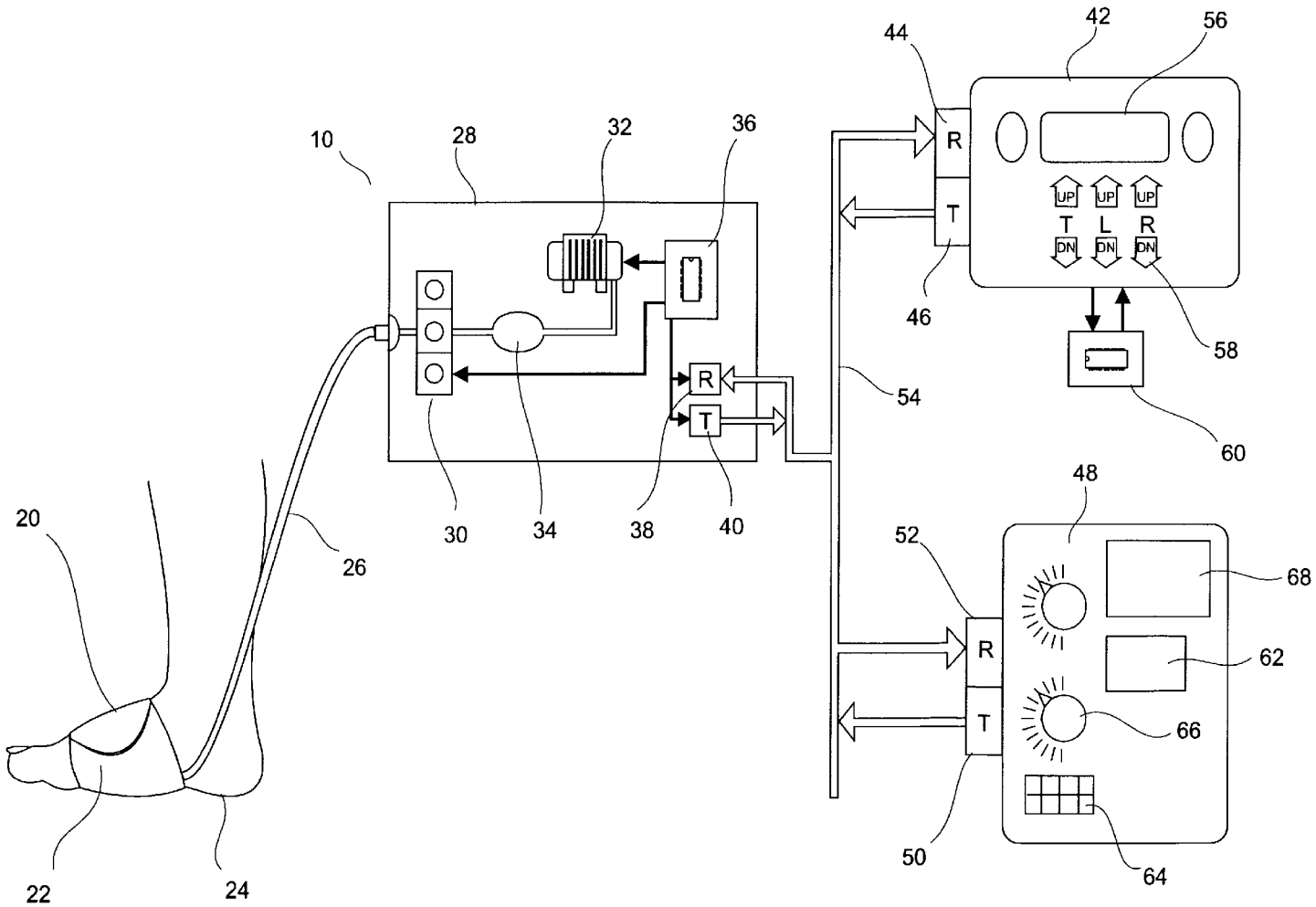
FIG. 1 is a schematic diagram of the remote controllable medical pumping apparatus of the present invention.

Referring now to the drawings, FIG. 1 depicts a remote controllable medical pumping apparatus 10 of the present invention. An inflatable bag 20 shaped to conform to and be placed about a human foot 24 is secured to foot 24 by a fastener 22. The inflatable bag 20 can be made of flexible nonpuncturable material such as polyvinyl chloride or polyurethane film which is enveloped and peripherally sealed. The fastener 22 may be a belt, strap or a VELCRO™ flap.

A pneumatic device 28 capable of delivering cyclical pneumatic pressure to the bag 20 is connected thereto via a conduit 26. The conduit 26 can be fashioned from a plastic hose six to ten feet in length, for example, with a lumen diameter between one quarter and one half inch. Pneumatic device 28 includes a valve assembly 30 operably connected to the conduit 26 for controlling the inflation and venting of the bag 20. A sealed air reservoir 34 operably connects to the valve assembly 30 and is capable of withstanding as much pressure as is required for the operation of the apparatus 10 and having an adequate safety margin as is readily ascertainable by one skilled in the art. An electrically powered fluid compressor 32 operably connects to the reservoir 34 for providing compressed air thereto. Also, included is a controller processing unit (cpu) 36 operably connected to the fluid compressor 32 and valve assembly 30 having nonvolatile memory capable of manipulating and storing control data from a receiver 38 and further capable of accumulating specific information, such as accumulated patient compliance data, diagnostic data and other patient physiological related data, and conveying the same to a transmitter 40. The receiver 38 is capable of receiving, decoding and preprocessing control data, such as the pressure and cycle time interval, and the transmitter 40 is capable of pre-processing, encoding and transmitting such data.

As further depicted in FIG. 1, a digital communications data link 54 is provided via the receiver 38 and the transmitter 46 and the receiver 44 and transmitter 40 to communicatively connect a controller 42 with the pneumatic device 28 and associated controller 48. Communications data link 54 includes a digital communications link, such as a hardwired link (directly connected), a wireless infrared link, a wireless radio frequency link, a local area network, or a standard telephone modem link such as is currently employed to enable computers to communicate with each other and their peripherals. The communications protocol of data link 54 can be of an industry standard format such as the RS-232 protocol.

Figure 2:
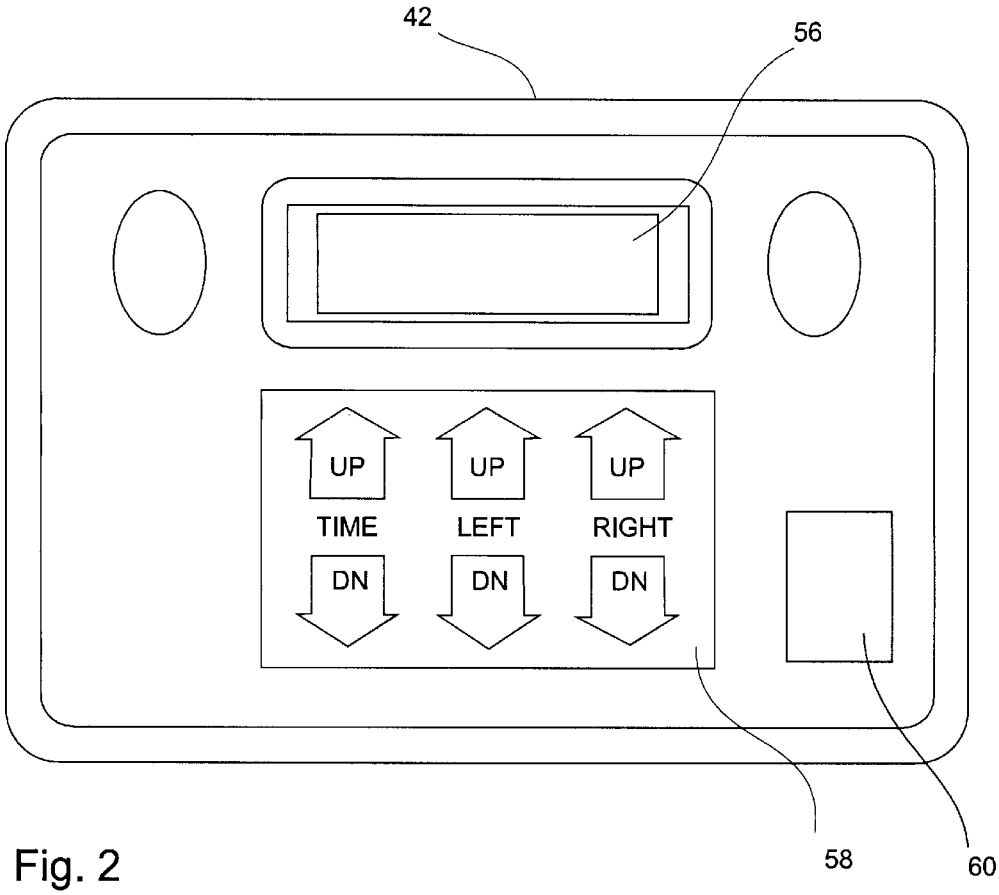
FIG. 2 is a remote control of the present invention.

The controller 42 (also shown in FIG. 2) includes a receiver 44 capable of receiving, decoding and preprocessing data received from the pneumatic device 28 via the digital communications data link 54. Additionally, controller 42 includes a transmitter 46 capable of preprocessing, encoding and transmitting control data from the controller 42 to the pneumatic device 28 where it is received, manipulated and stored by cpu 36. The controller 42 includes a display 56, such as a liquid crystal display or light emitting diode array for displaying either the control data signal or the data signal received from receiver 44, a keypad 58 for the manual entering of data corresponding to the amount of pressure, time and cycle to be transmitted via communications link 54, and a microprocessor 60 for (I) manipulating received data signals or data signals from keypad 58, (ii) displaying data on display 56 and (iii) communicating data with the receiver 44 and transmitter 46.

Figure 4:
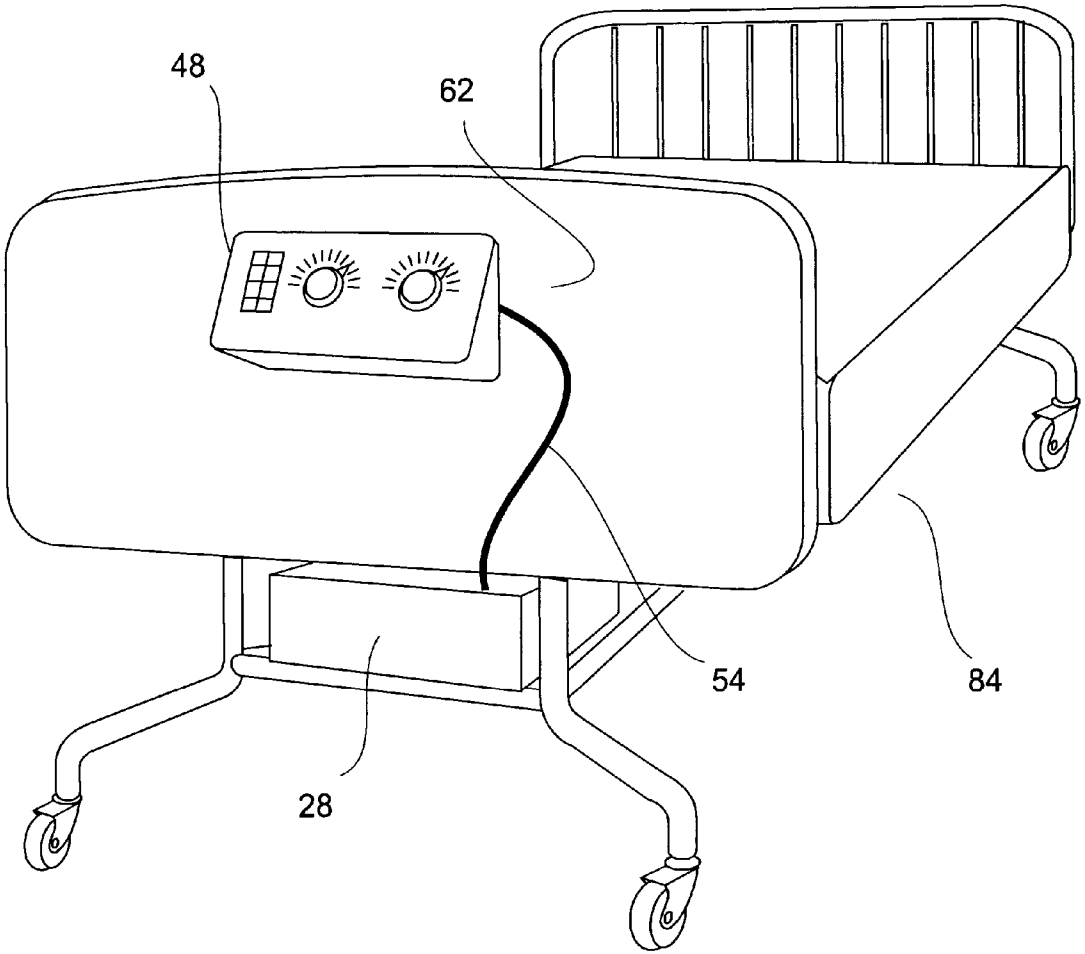
FIG. 4 is a diagram of the medical pumping apparatus integrated into a hospital bed.

The controller 48 is, for example as shown in FIG. 4, operably associated with a hospital bed 84, and includes a receiver 52 and a transmitter 50, both of which likewise serve the function as described above, and microprocessor 62 which may likewise include a keypad 64, control knobs 66 for operating a conventional adjustable hospital bed as is known in the art and display 68 capable of producing the necessary control data and transmitting same via communications link 54 to the pneumatic device 28.

It is understood in the invention that the controller 42 may be either manually, manually aided or automated with the use of artificial intelligence software being integrated into the micro processor 60, as is known in the art. Additionally, such intelligence can be integrated into the cpu 36 and/or microprocessor 62.

Figure 3:
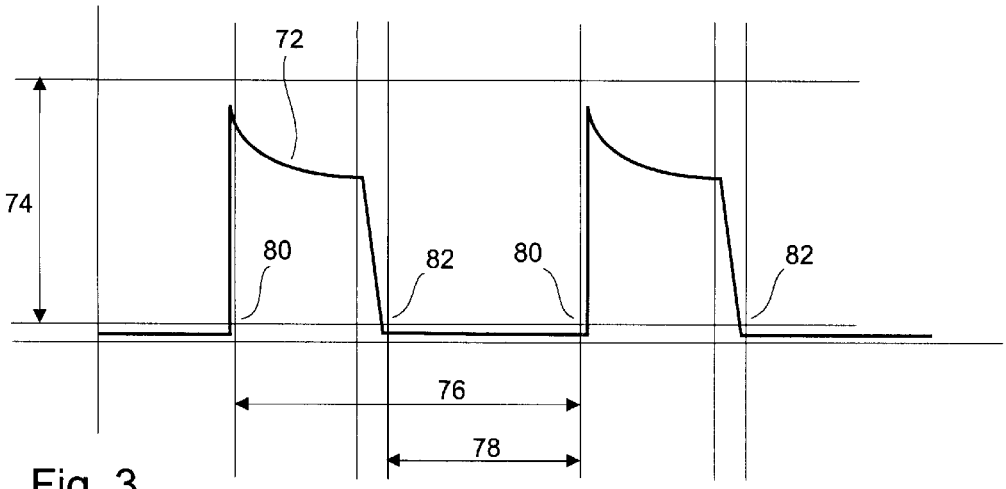
FIG. 3 is a pressure verses time diagram illustrating the inflation cycle and venting cycle normally associated with the sequence of the present invention.

Referring now to FIG. 3, the timing diagram for the preferred system is depicted. The graph 72 shows fluid pressure in the bag 20 with respect to time. At a predetermined time 80, valve assembly 30 compresses fluid to the bag 20 where the pressure is maintained until predetermined time 82 when the compressed fluid is vented to atmosphere via valve assembly 30. The time between the inflation of the preceding cycle and the inflation of the succeeding cycle is given at 76. The time between the venting of the preceding cycle and the inflation of the succeeding cycle is given at 78. The peak pressure level is shown at 74. These control parameters are set by the controller 42 or controller 48 and transmitted to the pneumatic fluid supply device 28 by way of the digital communications link 54.

Referring now to FIG. 4, the medical pumping apparatus 10 may be removably or permanently associated with the hospital bed 84 of the present invention. The pneumatic fluid supply device 28 can be installed at a location under the bed on the bed frame, for example, and may be operatively connected to a power source available through the bed 84. The digital communications data link 54 is connected to pneumatic fluid supply device 28 and routed through bed 84 to connect to the controller 48 attached to the side of the bed 84.

By so connecting the controllers 42 and 48 with the device 28, a single communications link is established which permits remote access to the device 28 and bed 84, for example, for determining and controlling the same.

The above described invention is set forth for exemplary purposes only and is not intended to be limiting in scope of the claims appended hereto. Accordingly, modifications, derivations and improvements will be readily apparent to those skilled in the art and should be encompassed by the claims hereto.

What is claimed is:

1. A remote controllable medical pumping apparatus for controlling from a local site application of compressive pressures to a part of a human body at a remote site, comprising:

means disposed at the remote site for applying compressive pressure about the body part in accordance with a predetermined pressure;

means disposed at the remote site and operatively associated with said pressure means for sensing said predetermined pressure;

first transmitting means disposed at the remote site operatively associated with the sensing means for transmitting a signal in response to said sensed pressure;

first receiving means disposed at the local site for receiving said transmitted signal;

first manipulating and display means disposed at the local site and operably associated with said first receiving means for manipulating and displaying said transmitted signal to enable selection of a preferred pressure signal by at least one of a manually aided controller and an automated controller;

second transmitting means disposed at the local site and operatively associated with said first manipulating and display means for transmitting said preferred pressure signal to the remote site;

second receiving means disposed at the remote site for receiving said preferred pressure signal; and second manipulating means disposed at the remote site and operatively associated with said second receiving means for manipulating said received preferred pressure signal and actuating said pressure means to cause application of pressure to the body part in accordance with said generated preferred pressure signal.

2. The remote controllable medical pumping apparatus of claim 1, which further includes means disposed at the remote site for sensing patient compliance and wherein said first transmitting means further transmits a signal in response thereto and wherein said first receiving means further receives said patient compliance signal and wherein said first manipulating means further manipulates and displays said transmitted patient compliance signal for use in selection of said preferred pressure signal.

3. The remote controllable medical pumping apparatus of claim 1, which further includes means disposed at the remote site for sensing physiological data and wherein said first transmitting means further transmits a signal in response thereto and wherein said first receiving means further receives said physiological signal and wherein said first manipulating means further manipulates and displays said transmitted physiological signal for use in selection of said preferred pressure signal.

4. The remote controllable medical pumping apparatus of claim 1, wherein said pressure means, said first transmitter means, said second receiver means and said second manipulating means are operatively associated with a hospital bed.

5. The remote controllable medical pumping apparatus of claim 1, which further includes means disposed at the remote site for sensing cycle interval and wherein said first transmitting means further transmits a signal in response thereto and wherein said first receiving means further receives said cycle interval signal, wherein said first manipulating and display means further displays said cycle interval signal for use in selection of a preferred cycle interval signal, said second transmitter transmits said preferred cycle interval signal, said second receiver receives said preferred cycle interval signal and said second manipulating means manipulates said preferred cycle interval signal and actuates said pressure means to apply pressure for a period of time in accordance with said preferred cycle interval.

6. A remote controllable medical pumping apparatus for controlling from a local site application of compressive pressures to a part of the human body at a remote site, comprising means disposed at the remote site for applying compressive pressure about the body part in accordance with a predetermined pressure;

means disposed at the remote site and operatively associated with said pressure means for sensing said predetermined pressure;

first transmitting means disposed at the remote site operatively associated with said sensing means for transmitting a signal to the local site in response to said sensed pressure;

first receiving means disposed at the local site for receiving said transmitted signal;

first manipulating means disposed at the local site and operably associated with said first receiving means for manipulating said transmitted signal to generate a preferred pressure signal by at least one of a manually aided controller and an automated controller;

second transmitting means disposed at the local site and operatively associated with said first manipulating means for transmitting said preferred pressure signal to the remote signal;

second receiving means disposed at the remote site for receiving said preferred pressure signal; and second manipulating means disposed at the remote site and operatively associated with said second receiving means for manipulating said received preferred pressure signal and actuating said pressure means to cause application of pressure to the body part in accordance with said generated preferred pressure signal.

7. The remote controllable medical pumping apparatus of claim 6, which further includes means disposed at the remote site for sensing patient compliance and wherein said first transmitting means further transmits a signal in response thereto and wherein said first receiving means further receives said patient compliance signal and wherein said manipulating means further manipulates said transmitted patient compliance signal to generate said preferred pressure signal.

8. The remote controllable medical pumping apparatus of claim 7, which further includes means disposed at the remote site for sensing physiological data and wherein said first transmitting means further transmits a signal in response thereto and wherein said first receiving means further receives said physiological signal and wherein said manipulating means further manipulates said transmitted physiological signal to generate said preferred pressure signal.

9. The remote controllable medical pumping apparatus of claim 6, wherein said pressure means, said first transmitter means, said second receiver means and said second manipulating means are operatively associated with a hospital bed.

10. The remote controllable medical pumping apparatus of claim 6, which further includes means disposed at the remote site for sensing cycle interval and wherein said first transmitting means further transmits a signal in response thereto and wherein said first receiving means further receives said cycle interval signal, wherein said first manipulating means further generates a preferred cycle interval signal, said second transmitter transmits said preferred cycle interval signal, said second receiver receives said preferred cycle interval signal and said second manipulating means manipulates said preferred cycle interval signal and actuates said pressure means to apply pressure for a period of time in accordance with said preferred cycle interval.

11. The remote controllable medical pumping apparatus of claim 6, which further includes means disposed at the local site for displaying said signals.

12. A remote controllable medical pumping apparatus for controlling from a local site application of compressive pressures to a part of a human body at a remote site, comprising:

means disposed at the remote site for applying compressive pressure about the body part in accordance with a predetermined pressure cycle interval;

means disposed at the remote site and operatively associated with said pressure means for sensing said predetermined pressure cycle interval;

first transmitting means disposed at the remote site operatively associated with said sensing means for transmitting a signal to the local site in response to said sensed pressure cycle interval;

first receiving means disposed at the local site for receiving said transmitted signal;

first manipulating means disposed at the local site and operably associated with said first receiving means for manipulating and displaying said transmitted signal to enable selection of a preferred pressure cycle interval signal by at least one of a manually aided controller and an automated controller;

second transmitting means disposed at the local site and operatively associated with said first manipulating means for transmitting said preferred pressure cycle interval signal to the remote site;

second receiving means disposed at the remote site for receiving said preferred pressure cycle interval signal; and second manipulating means disposed at the remote site and operatively associated with said second receiving means for manipulating said received preferred pressure cycle interval signal and actuating said pressure means to apply pressure for a period of time in accordance with said preferred pressure cycle signal.

13. The remote controllable medical pumping apparatus of claim 1, which further includes means disposed at the remote site for sensing patient compliance and wherein said first transmitting means further transmits a signal in response thereto and wherein said first receiving means further receives said patient compliance signal and wherein said first manipulating means further manipulates and displays said transmitted patient compliance signal for use in selection of said preferred cycle interval signal.

14. The remote controllable medical pumping apparatus of claim 1, which further includes means disposed at the remote site for sensing physiological data and wherein said first transmitting means further transmits a signal in response thereto and wherein said first receiving means further receives said physiological signal and wherein said first manipulating means further manipulates and displays said transmitted physiological signal for use in selection of said preferred cycle interval signal.

15. The remote controllable medical pumping apparatus of claim 1, wherein said pressure means, said first transmitter means, said second receiver means and said second manipulating means are operatively associated with a hospital bed.

16. The remote controllable medical pumping apparatus of claim 1, which further includes means disposed at the remote site for sensing pressure and wherein said first transmitting means further transmits a signal in response thereto and wherein said first receiving means further receives said pressure signal, wherein said first manipulating and display means further displays said pressure signal for use in selection of a preferred pressure signal, said second transmitter transmits said preferred pressure signal, said second receiver receives said preferred pressure signal and said second manipulating means manipulates said preferred pressure signal and actuates said pressure means to cause application of pressure to the body part in accordance with said generated preferred pressure signal.

17. A remote controllable medical pumping apparatus for controlling from a local site application of compressive pressures to a part of a human body at a remote site, comprising:

means disposed at the remote site for applying compressive pressure about the body part in accordance with a predetermined pressure cycle interval;

means disposed at the remote site and operatively associated with said pressure means for sensing said predetermined pressure cycle interval;

first transmitting means disposed at the remote site operatively associated with said sensing means for transmitting a signal to the local site in response to said sensed pressure cycle interval;

first receiving means disposed at the local site for receiving said transmitted signal;

first manipulating means disposed at the local site and operably associated with said first receiving means for manipulating said transmitted signal to generate a preferred pressure cycle interval signal by at least one of a manually aided controller and an automated controller;

second transmitting means disposed at the local site and operatively associated with said first manipulating means for transmitting said preferred pressure cycle interval signal to the remote site;

second receiving means disposed at the remote site for receiving said preferred pressure cycle interval signal; and second manipulating means disposed at the remote site and operatively associated with said second receiving means for manipulating said received preferred pressure cycle interval signal and actuating said pressure means to apply pressure for a period of time in accordance with said preferred cycle signal.

18. The remote controllable medical pumping apparatus of claim 17, which further includes means disposed at the remote site for sensing patient compliance and wherein said first transmitting means further transmits a signal in response thereto and wherein said first receiving means further receives said patient compliance signal and wherein said manipulating means further manipulates said transmitted patient compliance signal to generate said preferred cycle interval signal.

19. The remote controllable medical pumping apparatus of claim 17, which further includes means disposed at the remote site for sensing physiology and wherein said first transmitting means further transmits a signal in response thereto and wherein said first receiving means further receives said physiological signal and wherein said manipulating means further manipulates said transmitted physiological signal to generate said preferred cycle interval signal.

20. The remote controllable medical pumping apparatus of claim 17, wherein said pressure means, said first transmitter means, said second receiver means and said second manipulating means are operatively associated with a hospital bed.

21. The remote controllable medical pumping apparatus of claim 17, which further includes means disposed at the remote site for sensing pressure and wherein said first transmitting means further transmits a signal in response thereto and wherein said first receiving means further receives said pressure signal, wherein said first manipulating means further generates a preferred pressure signal, said second transmitter transmits said preferred pressure signal, said second receiver receives said preferred pressure signal and said second manipulating means manipulates said preferred pressure signal and actuates said pressure means to cause application of pressure to the body part in accordance with said generated preferred pressure signal.

22. The remote controllable medical pumping apparatus of claim 17, which further includes means disposed at the local site for displaying said signals.

* * * * *